US006568011B2

(12) United States Patent
Fisher et al.

(10) Patent No.: US 6,568,011 B2
(45) Date of Patent: May 27, 2003

(54) INFLATABLE MATTRESS

(75) Inventors: David R. Fisher, Rancho Palos Verdes, CA (US); Yaw-Yuan Hsu, Taipei (TW); Chin-Hsiang Pan, Taipei (TW)

(73) Assignee: Intex Recreation Corp., Long Beach, CA (US)

( * ) Notice: Subject to any disclaimer, the term of this patent is extended or adjusted under 35 U.S.C. 154(b) by 0 days.

(21) Appl. No.: 09/756,487

(22) Filed: Jan. 4, 2001

(65) Prior Publication Data

US 2002/0083528 A1 Jul. 4, 2002

(51) Int. Cl.[7] ..... A47C 27/08
(52) U.S. Cl. ..... 5/706; 5/711; 5/712
(58) Field of Search ..... 5/706, 710, 711, 5/712, 713, 654, 655.3, 644

(56) References Cited

U.S. PATENT DOCUMENTS

| | | | | | |
|---|---|---|---|---|---|
| 1,371,919 | A | * | 3/1921 | Mahony | 5/401 |
| 1,625,810 | A | * | 4/1927 | Krichbaum | 5/712 X |
| 1,793,703 | A | * | 2/1931 | Krichbaum | 5/712 X |
| 2,318,492 | A | * | 5/1943 | Johnson | 5/712 |
| 2,604,641 | A | * | 7/1952 | Reed | 5/711 X |
| 3,705,429 | A | | 12/1972 | Nail | 5/349 |
| 4,389,742 | A | * | 6/1983 | DeWitt | 5/654 |
| 4,405,129 | A | * | 9/1983 | Stuckey | 5/654 X |
| 4,483,030 | A | * | 11/1984 | Flick et al. | 5/691 |
| 4,631,767 | A | * | 12/1986 | Carr et al. | 5/714 |
| 5,022,109 | A | * | 6/1991 | Pekar | 5/711 X |
| 5,044,030 | A | * | 9/1991 | Balaton | 5/710 |
| 5,109,560 | A | | 5/1992 | Uetake | 5/453 |
| 5,408,711 | A | | 4/1995 | McClelland | 5/461 |
| 5,561,873 | A | * | 10/1996 | Weedling | 5/711 |
| 5,598,593 | A | | 2/1997 | Wolfe | 5/710 |
| 5,604,945 | A | | 2/1997 | Fisher et al. | 5/706 |
| 5,642,544 | A | * | 7/1997 | Munoz | 5/644 |
| 5,890,245 | A | | 4/1999 | Klearman et al. | 5/714 |
| 5,960,495 | A | | 10/1999 | Hsu et al. | 5/706 |
| 6,016,582 | A | | 1/2000 | Larson | 5/691 |
| 6,073,291 | A | * | 6/2000 | Davis | 5/711 |
| 6,076,214 | A | | 6/2000 | Klimenko | 5/710 |
| 2002/0050010 | A1 | * | 5/2002 | Shimada | 5/706 |
| 2002/0083528 | A1 | * | 7/2002 | Fisher et al. | 5/706 |

* cited by examiner

*Primary Examiner*—Robert G. Santos
(74) *Attorney, Agent, or Firm*—Lewis, Brisbois, Bisgaard & Smith LLP

(57) ABSTRACT

An inflatable mattress comprises a flexible bottom layer, a top layer sealed to the bottom layer through a wall, wherein the bottom and top layers and the wall define an outer frame of the inflatable mattress, and a middle layer disposed between the top and bottom layers. The bottom surface of the middle layer is sealed to the bottom layer through a plurality of laterally disposed I-beam structures to form a lower chamber. The top surface is attached to the top layer through a plurality of X-beam structures to form an upper chamber. A peripheral edge of the middle layer may be sealed with the wall to prevent the upper and lower chambers from being in fluid communication with each other. Alternatively, the peripheral edge may be detached from the wall so that the upper and lower chambers are in fluid communication with each other.

5 Claims, 5 Drawing Sheets

INFLATABLE MATTRESS

BACKGROUND OF THE INVENTION

1. Field of the Invention

The present invention relates to inflatable structures, and more particularly, to inflatable mattresses and other similar inflatable structure or furniture, which are easily inflated and deflated by using air pumps.

2. Discussion of the Related Art

Air mattresses have enjoyed wide popularity for a number of reasons. When not in use, the air mattress is capable of being deflated to a substantially two-dimensional geometry which can be folded compactly and stored and transported quite easily. When inflated, air mattresses provide the user with a generally high level of comfort as the user is literally supported upon a cushion of air isolating the user from what would be an otherwise uncomfortable sleeping surface such as natural terrain encountered on a typical camping excursion.

Conventional inflatable air mattresses are available in a wide variety of sizes and configurations. Air mattresses are used in the health care industry, for example, as a patient mover or stretcher, or as a therapeutic mattress. More commonly, inflatable air mattresses are used in residential and recreational applications as a convenient spare bed in the home, or at the beach or camp site.

Although air mattresses are relatively inexpensive and enjoy those advantages recited above, such products are not universally embraced by the consuming public and they rarely are seen as suitable replacements for more conventional bedding. One of the primary reasons for this lack of universal acceptance is that air mattresses, at least to date, have not provided the user with a generally level, comfortable and firm sleeping surface. Conventional air mattresses tend to exhibit a characteristic "give" where the user's body causes redistribution of air within the mattress resulting in areas of "bulge" surrounding the user's body.

Attempts have been made to address this perceived shortcoming in several different ways. For example, U.S. Pat. No. 3,705,429 discloses an inflatable mattress by locating a plurality of inflatable beams, columns or chambers within an outer inflatable chamber. Each beam is separately inflatable with its own inflation valve to provide inflated substructures within an overall air mattress geometry. Although conceptually the configuration shown in U.S. Pat. No. 3,705,429 is of interest, in practice, it provides only modest improvement over mattresses without such expedients and, noting that each beam is separately inflatable, the task of inflating the mattress and each individual beam can prove daunting for many users. In addition, each beam represents a separate area of potential leakage so that its use is not as practical as one might hope.

Conventional ventilating mattresses are often formed with a plurality of inflatable mattress sections (e.g., a head section, a torso section, and a leg section) which may be inflated to different pressures. Such mattresses generally have tubes or conduits extending from a source of pressurized air to the mattress sections.

A disadvantage of conventional ventilating mattresses is that they are generally relatively expensive to make because a plurality of sections or chambers are connected together.

Therefore, there is a need in the art for an inflatable mattress that can be easily and inexpensively manufactured while maintaining the integrity of its shape and comfort of multichamber mattress.

SUMMARY OF THE INVENTION

Accordingly, the present invention is directed to an inflatable mattress that substantially obviates one or more of the problems due to limitations and disadvantages of the related art.

It is an object of the present invention to provide an inflatable mattress which characteristically creates a generally level, comfortable and firm sleeping surface while not being overly complex to produce and maintain.

A further object of the present invention is to provide an inflatable mattress with a sense of firmness and stability characteristic of traditional bedding.

It is a further object of the present invention to provide an inflatable mattress that is easily and quickly inflated and deflated, and able to be stored conveniently.

It is another object of the present invention to provide an inflatable mattress that is aesthetically pleasing, secure, and comfortable to use.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an inflatable mattress comprises a bottom layer; a top layer sealed to the bottom layer through a wall, wherein the bottom and top layers and the wall define an outer frame of the mattress; and a middle layer disposed between the top and bottom layers. A bottom surface of the middle layer is attached to the bottom layer through a plurality of first sealing structures to form a first chamber. A top surface is attached to the top layer through a plurality of second sealing structures to form a second chamber.

According to one aspect of the present invention, the first sealing structures are I-beam structures, and the second sealing structures are X-beam structures. The I-beam structures are equally spaced from each other and latitudinally disposed between the middle and the bottom layers. Preferably, a peripheral edge of the middle layer is sealed against an inner surface of the wall. As a result, the first and the second chambers are not in fluid communication with each other.

According to another aspect of the present invention, the peripheral edge of the middle layer is at least partially or entirely detached from the wall. As a result, the first and the chambers are in fluid communication with each other.

According to another aspect of the invention, an inflatable assembly comprises an inflatable upper chamber defined by a top layer and a middle layer attached to each other through a plurality of X-beam sealing structures; and an inflatable lower chamber disposed adjacent to the upper chamber and defined by a bottom layer and the middle layer. The upper and lower chambers are separated by the middle layer. The middle and the bottom layers are attached to each other through a plurality of I-beam sealing structures.

It is to be understood that both the foregoing general description and the following detailed description are exemplary and explanatory and are intended to provide a further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF THE PREFERRED EMBODIMENTS

With reference to the drawings, and in particular to FIGS. 1–10 thereof, an inflatable mattress embodying the principles and concepts of the present invention will be described.

Figure 2:
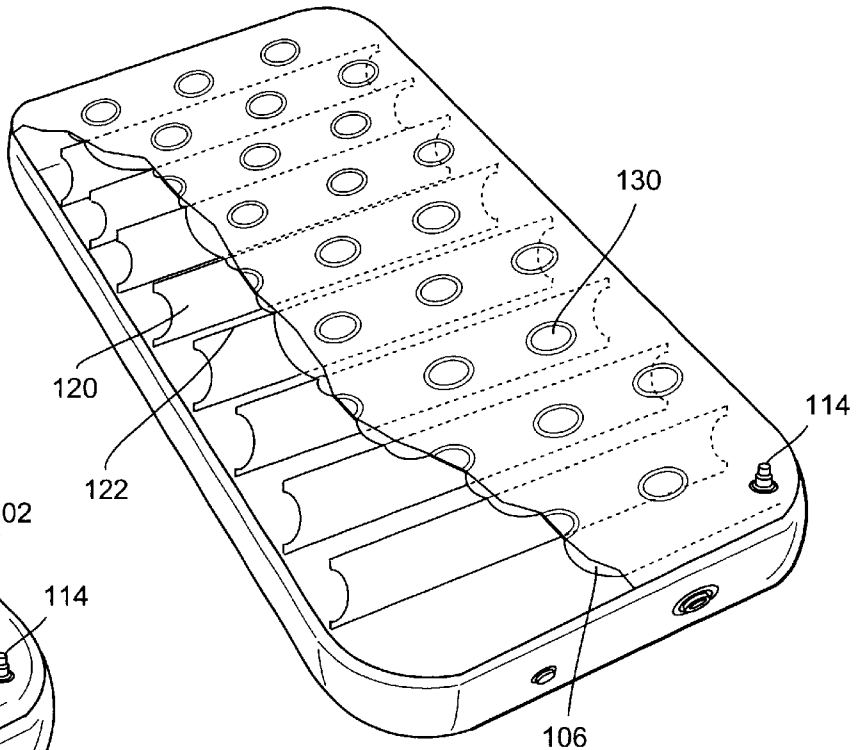
FIG. 2 illustrates a perspective view of the first embodiment in partial cutaway illustrating inner features of the present invention.
Figure 1:
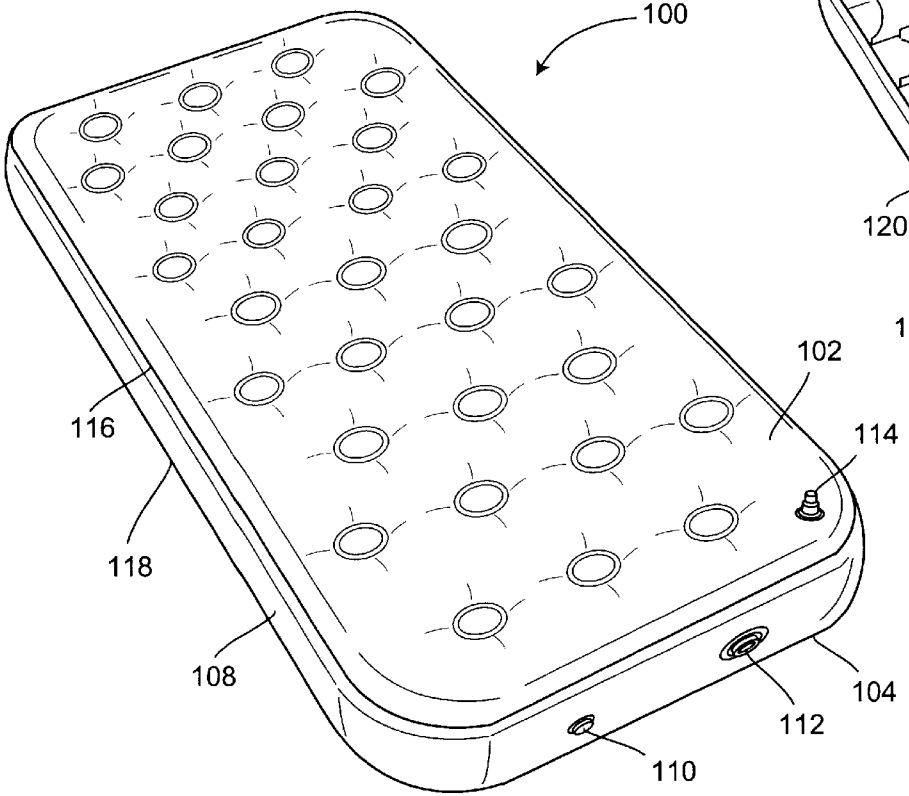
FIG. 1 illustrates a perspective view of first embodiment of the inflatable mattress of the present invention.

FIGS. 1–5 illustrate a first embodiment of the present invention. In particular, FIG. 1 illustrates a perspective view of the first embodiment of the inflatable mattress 100 of the present invention. FIG. 2 illustrates a perspective view of the first embodiment in partial cutaway illustrating the inner features of the present invention.

Referring to FIGS. 1 and 2, the inflatable mattress 100 comprises a top layer 102 and a bottom layer 104 connected to the top layer 102 through a vertical wall 108. In particular, the top layer 102 is connected to the wall 108 throughout the upper periphery of the wall 108 at an upper seal 116. Similarly, the bottom layer 104 is connected to the wall 108 throughout the lower periphery of the wall 108 at a lower seal 118. As a result, the top layer 102, bottom layer 104 and wall 108 form the outer structure of the inflatable mattress 100 that is gas or fluid tight.

In the preferred embodiment, the material for the top layer 102, bottom layer 104 and 10 wall 108 is comprised of a flexible and resilient material, such as polyvinyl chloride sheeting (typically referred to as PVC), thermoplastic impregnated cloth or other materials known to one of ordinary skill in the art. The side edges 116, 118 of the wall 108 are fused with the top and bottom layers 102, 104 using such process as radio frequency (RF) sealing or other process known to one of ordinary skill in the art.

Figure 5:
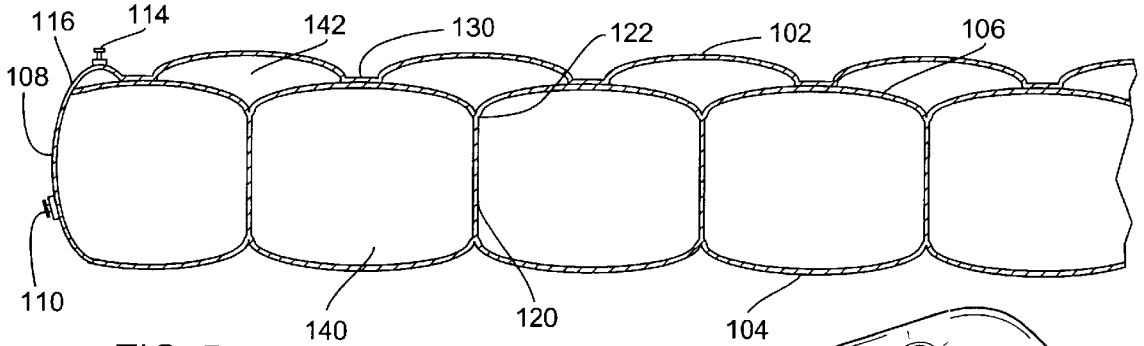
FIG. 5 illustrates a cross-sectional view of the first embodiment of the inflatable mattress.

According to the first embodiment of the inflatable mattress 100 shown in FIG. 2, there is provided a middle layer 106 disposed between the top and bottom layers 102 and 104. The peripheral edge of the middle layer 106 is sealed with the inner surface of the wall 108, preferably at the upper seal 116, to separate the lower and the upper chambers that are independently inflatable. In other words, the lower chamber 140 and the upper chamber 142, both of which are shown in FIG. 5, are not in gaseous or fluid communication with each other. Preferably, the middle layer 106 is made with the same material as that of other layers and is attached to the inner walls using the RF sealing process or other suitable process known to one of ordinary skill in the art.

For inflating, the inflatable mattress 100 according to the first embodiment is equipped with two valves. The lower chamber valve 110 is in gaseous or fluid communication with the lower chamber 140, and the upper chamber valve 114 is in gaseous or fluid communication with the upper chamber 142. The lower chamber valve 110 is preferably connected to the wall 108, and the upper chamber valve 114 is connected to comer of the top layer 102.

Preferably, the valves 110 and 114 are standard safety valves commercially available and known to those of skill in the art. Preferably, the valves 110 and 114 are one-way valves, or self-sealing, which allow air flow into the chambers (but must be pinched to allow air flow out of the chambers). A forceful stream of air from a foot pump, hand pump, compressed air container and the like can be introduced into the chambers through these valves 110 and 114. In operation, the safety valves are typically used to adjust the desired degree of inflation of the lower and upper chambers.

For deflating, the lower chamber 140 is in gaseous communication with an outlet 112 which is connected to the wall 108. The structures of the valves 110 and 114 and the outlet 112 are commonly known to one of ordinary skill in the art. The outlet 112 preferably has a wide opening for fast deflation.

Figure 4:
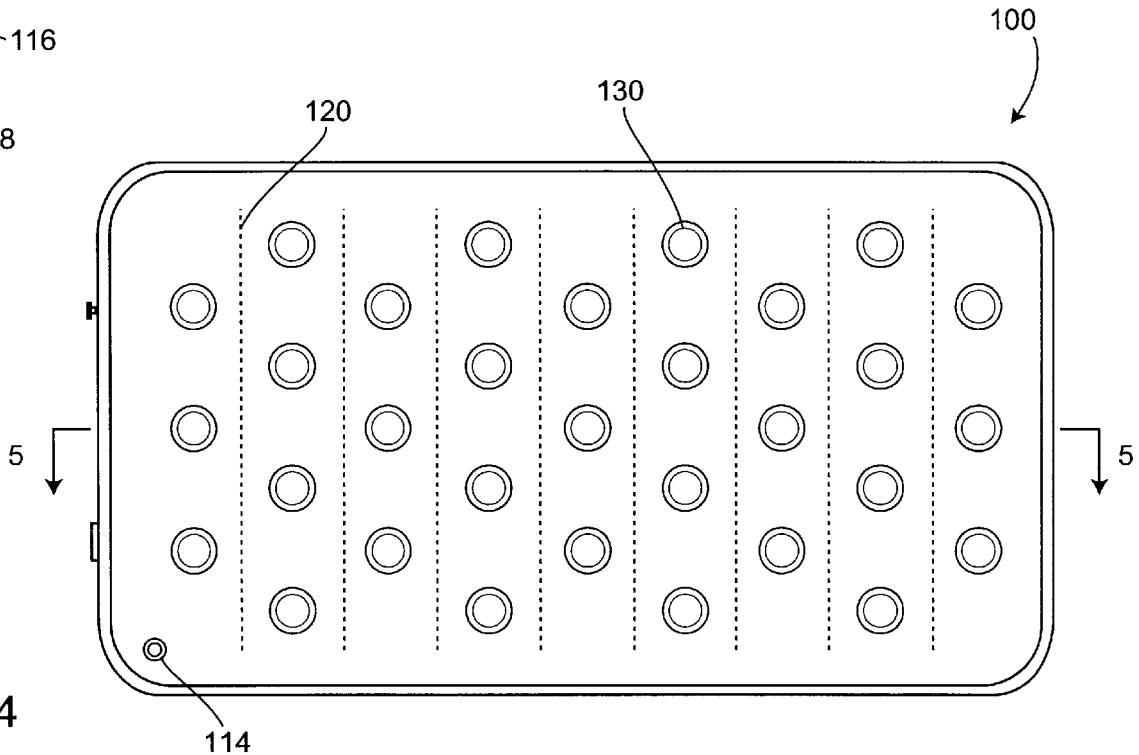
FIG. 4 illustrates a top plan view of the first embodiment of the present invention with the I-beam sealing structures shown in phantom lines.
Figure 3:
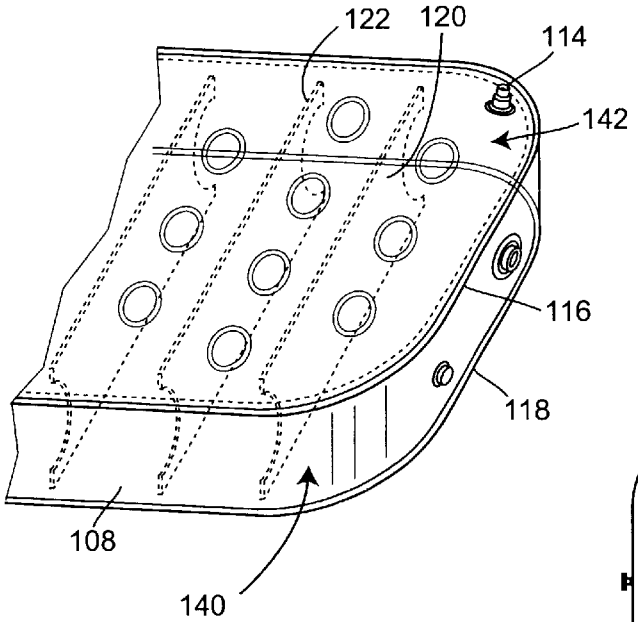
FIG. 3 illustrates a partial perspective view of the first embodiment showing inner features of the present invention.

FIG. 3 illustrates a partial perspective view of the first embodiment showing the inner features of the present invention. FIG. 4 illustrates a top plan view of the first embodiment of the present invention with the I-beam structures 120 shown in phantom lines.

According to FIGS. 3 and 4, the lower chamber 140 includes a series of latitudinally disposed vertical partitions or I-beam structures 120, which are heat or RF welded at 122 between the middle and bottom layers defining the lower chamber 140 along their entire lengths. The I-beam structures 120 act as retention members and function to limit the outward expansion of the middle and bottom layers 106, 104 of the lower chamber 140. This type of retention member is well known to one of ordinary skill in the art of inflation devices, such as floatation devices. Alternatively, although I-beam retention members are shown, other retention members may be used in the present invention, including coil-like beam, tube-like beam, column-like beam, quilt beam and the like. In the preferred embodiment, there are approximately 8 to 12 I-beam structures 120 for a queen size mattress.

Referring to FIGS. 4 and 5, the upper chamber 142 includes a plurality of X-beam heat sealing structures 130 each of which is in the form of a circle. The X-beam structures 130 are preferably formed by heat welding the top and middle layers 102, 106 together. The X-beam structures 130 function to limit outward expansion and therefore control the shape of the upper chamber 142. The X-beam structures 130 are heat welded in a series of equally spaced, circular welds along the top surface of the inflatable mattress 100. Differently shaped welds, such as elliptical, triangular or rectangular shaped welds may also be used to practice the present invention.

By sealing the top layer 102 to the middle layer 106 using the X-beam structures 130 and sealing the middle layer 106 and the bottom layer 104 using the I-beam structures 120, an appearance of a two-piece construction, with a pillow section being disposed on the top, can be created.

FIG. 5 illustrates a cross-sectional view of the first embodiment of the inflatable mattress. Referring to FIG. 5, the middle layer 106 is disposed between the top and bottom layers 102 and 104. The peripheral edge of the middle layer 106 is sealed with the inner surface of the wall 108, preferably at the upper seal 116 to separate the lower and the upper air chambers that are separately inflatable. As a result, the lower and upper chambers 140, 142 are not in gaseous or fluid communication with each other and require two separate valves 110 and 114 to inflate both chambers. The top layer 102 is attached to the middle layer 106 by preferably using X-beam structures 130. The middle layer 106 is then attached to the bottom layer 104 by preferably using I-beam structures 120.

Figure 6:
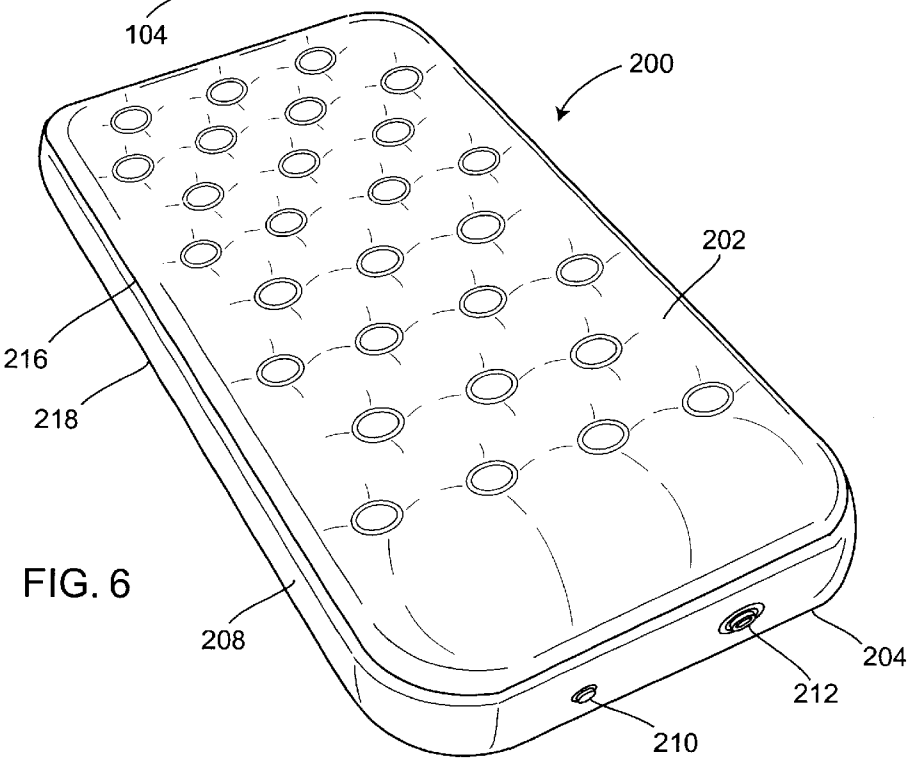
FIG. 6 illustrates a perspective view of second embodiment of the inflatable mattress of the present invention.
Figure 7:
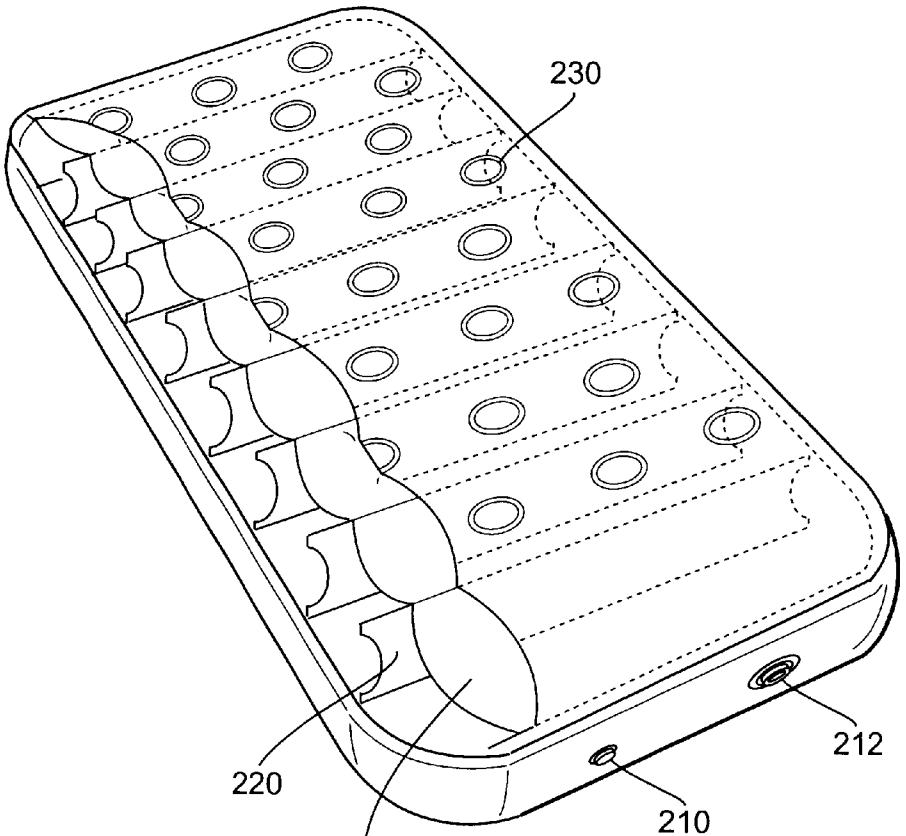
FIG. 7 illustrates a perspective view of the second embodiment in partial cutaway illustrating inner features of the present invention.

FIGS. 6–10 illustrate a second embodiment of the present invention. The main difference between the first and second embodiments of the present invention is that the inflatable mattress 200 according to the second embodiment has two chambers 240 and 242 which are in gaseous or fluid communication with each other while maintaining the shape, form and comfort of the first embodiment. FIG. 6 illustrates a perspective view of second embodiment of the inflatable mattress 200 of the present invention. FIG. 7 illustrates a perspective view of the second embodiment in partial cutaway illustrating the inner features of the present invention.

Figure 8:
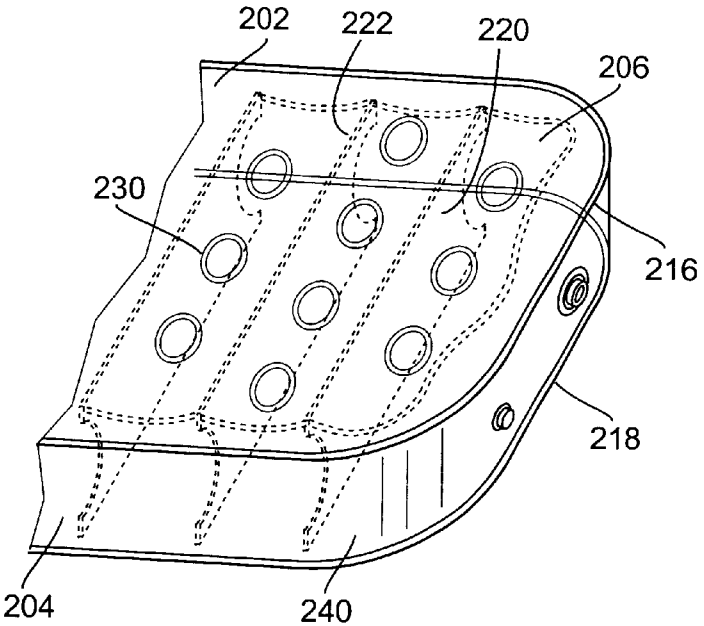
FIG. 8 illustrates a partial perspective view of the second embodiment showing inner features of the present invention.

Referring to FIGS. 6 to 8, the inflatable mattress 200 comprises a top layer 202 and a bottom layer 204 connected to the top layer 202 through a vertical wall 208. Similar to the first embodiment, the top layer 202 is connected to the wall 208 throughout the upper periphery of the wall 208 at an upper seal 216. The bottom layer 204 is connected to the wall 208 throughout the lower periphery of the wall 208 at a lower seal 218. As a result, the top layer 202, bottom layer 204 and wall 208 form the outer structure of the inflatable mattress 200.

According to the second embodiment of the inflatable mattress 100 shown in FIGS. 7 and 8, there is provided a middle layer 206 disposed between the top and bottom layers 202 and 204. The peripheral or outer edge of the middle layer 206 is either partially attached to or completely detached from the inner surface of the wall 208, and is only supported by I-beam and X-beam structures 220, 230.

For inflating, the inflatable mattress 200 according to the second embodiment is equipped with one valve 210. The valve 210 is in gaseous or fluid communication with both the upper and lower chambers 242, 240. The valve 210 is preferably connected to the wall 208. Preferably, the valve 210 is a self- sealing standard safety valve described above in connection with the first embodiment. For deflating, both chambers 242, 240 are in gaseous communication with an outlet 212 which is connected to the wall 208. The outlet 104 has a wide opening for fast deflation.

Figure 9:
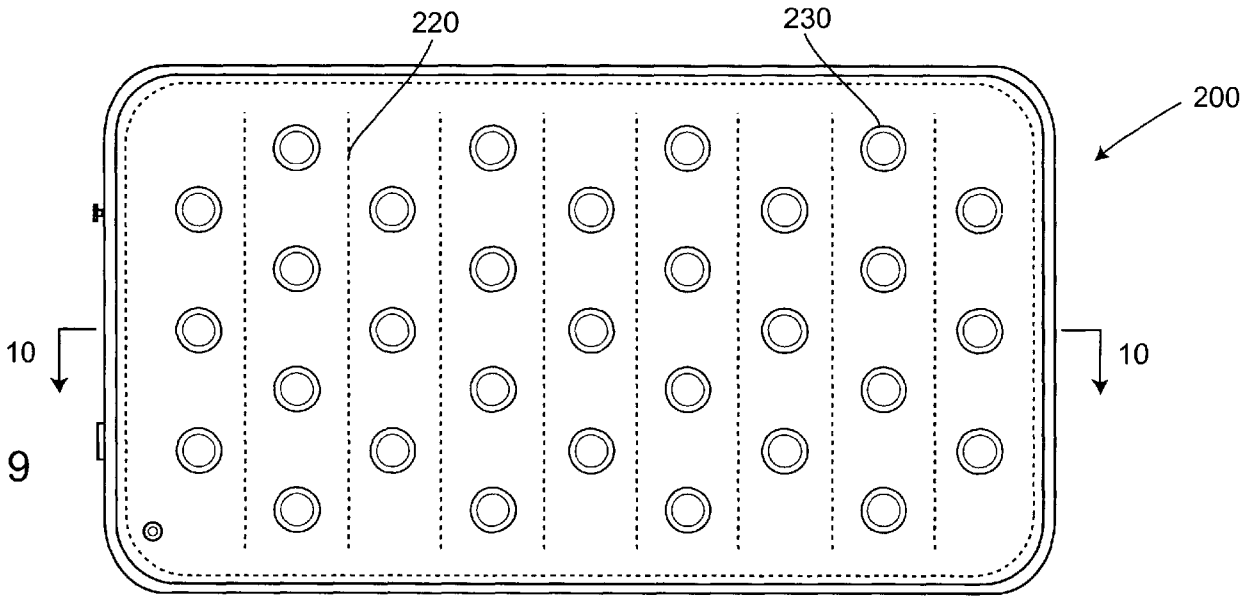
FIG. 9 illustrates a top plan view of the second embodiment of the present invention with the I-beam sealing structures and a middle layer shown in phantom lines.

FIG. 8 illustrates a partial perspective view of the first embodiment showing the inner features of the present invention. FIG. 9 illustrates a top plan view of the first embodiment of the present invention with the I-beam structures 222 shown in phantom lines.

According to FIGS. 8 and 9, the lower chamber 240 includes a series of latitudinally disposed vertical partitions or I-beam structures 220, which are heat welded or sealed at 222 to the middle and bottom layers 206, 204 along their entire lengths. The I-beam structures 220 act as retention members and function to limit the outward expansion of the middle and bottom layers 206, 204 of the lower chamber 240.

Figure 10:
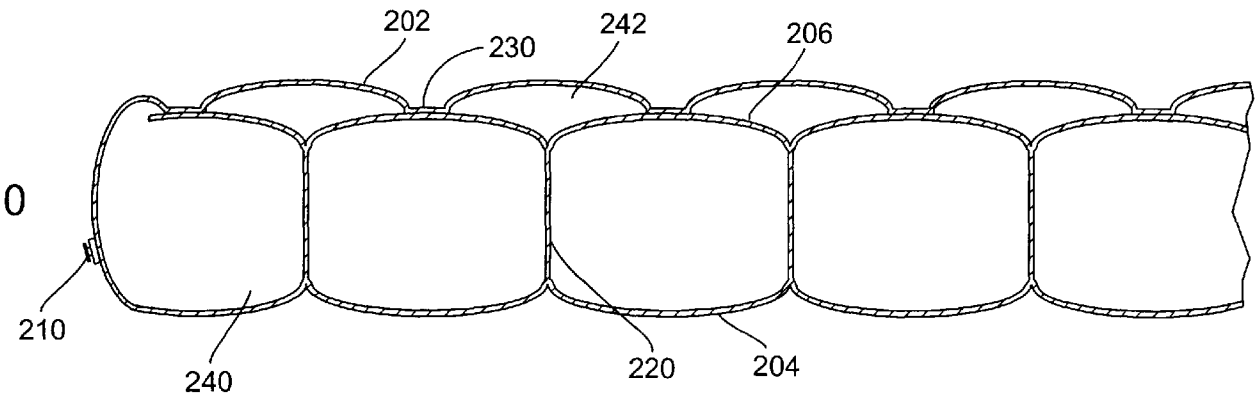
FIG. 10 illustrates a cross-sectional view of the second embodiment of the inflatable mattress.

Referring to FIGS. 9 and 10, the upper chamber 242 includes a plurality of X-beam heatsealing structures 230 each in the form of a circle. The X-beam structures 230 are formed by heat welding the top and middle layers 202, 206. The X-beam structures 230 are heat welded in a series of equally spaced, circular welds along the top surface of the inflatable mattress 200. Differently shaped welds, such as elliptical, triangular or rectangular shaped welds may also be used to practice the present invention.

FIG. 10 illustrates a cross-sectional view of the second embodiment of the inflatable mattress. Referring to FIG. 10 the middle layer 206 is disposed between the top and bottom layers 202 and 204. The peripheral edge of the middle layer 206 is preferably not attached to any inner surface of the inflatable mattress 200. As a result, the lower and upper chambers 240, 242 are in gaseous communication with each other and require only one inlet 210 to inflate both chambers. The top layer 202 is attached to the middle layer 206 by preferably using X-beam structures 230. The middle layer 206 is then attached to the bottom layer 204 by preferably using I-beam structures 220.

Typically, the chosen material of construction of the lower and upper chambers has a thickness of between about 12 and about 28 gauge, and preferably between about 12 and about 20 gauge. It has been found that the thickness within this range provides adequate strength while allowing each chamber to be easily inflated and is cost effective to produce. Most preferably, each chamber 140, 142 for the first embodiment and 240, 242 for the second embodiment, including its individual components and support structures (e.g., I-beams, X-beams, etc.) has a thickness of at least about 16 gauge.

Although the present invention is described in the context of an inflatable mattress, the use of two or more different types of beam structures with the use of interfacing layer (e.g., the middle layer 106) may be used in other inflatable structures, such as chairs, play structures, etc.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An inflatable mattress comprising:

a bottom layer;

a top layer sealed to the bottom layer through a wall, wherein the bottom and top layers and the wall define an outer frame of the mattress;

a middle layer is attached to the bottom layer through a plurality of first sealing structures, in the form of I-beam structures, to form a first inflatable chamber and a top surface of the middle layer is attached to the top layer through a plurality of second sealing structures, in the form of X-beam structures, to form a second inflatable chamber; and a peripheral edge of said middle layer is not attached to the wall.

2. The inflatable mattress of claim 1, wherein the first and the second chambers are in fluid communication with each other.

3. An inflatable mattress comprising:

a bottom layer;

a top layer sealed to the bottom layer through a wall, wherein the bottom and top layers and the wall define an outer frame of the inflatable mattress; and a middle layer disposed between the top and bottom layers, wherein a bottom surface of the middle layer is sealed to the bottom layer through a plurality of laterally disposed I-beam structures to form a lower chamber and a top surface is attached to the top layer through a plurality of X-beam structures to form an upper chamber, and wherein a peripheral edge of the middle layer is at least partially detached from the wall to allow the upper and lower chambers to be in fluid communication with each other.

4. An inflatable assembly comprising:

an upper chamber defined by a top layer and a middle layer to form a first inflatable cavity and attached to each other through a plurality of first sealing structures in the form of X-beams;

a lower chamber disposed adjacent to the upper chamber and defined by a bottom layer and the middle layer to form a second inflatable cavity, wherein the middle and bottom layers are attached to each other through a plurality of second sealing structures in the form of I-beam structures; and a peripheral edge of the middle layer is at least partially unsealed with the top layer, where the first and second chambers are in fluid communication with each other.

5. The inflatable assembly of claim 4, further comprising an inlet to inflate and deflate both the upper and lower chambers.

* * * * *